US006201436B1

(12) United States Patent
Hur et al.

(10) Patent No.: US 6,201,436 B1
(45) Date of Patent: Mar. 13, 2001

(54) BIAS CURRENT GENERATING CIRCUITS AND METHODS FOR INTEGRATED CIRCUITS INCLUDING BIAS CURRENT GENERATORS THAT INCREASE AND DECREASE WITH TEMPERATURE

(75) Inventors: Nak-won Hur; Jong-sun Kim, both of Kyungki-do (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/426,733

(22) Filed: Oct. 26, 1999

(30) Foreign Application Priority Data

Dec. 18, 1998 (KR) ..... 98-56204

(51) Int. Cl.[7] ..... G05F 1/10
(52) U.S. Cl. ..... 327/543; 327/512
(58) Field of Search ..... 327/378, 512, 327/513, 538, 539, 543; 323/312, 313, 314, 315, 316

(56) References Cited

U.S. PATENT DOCUMENTS 4,789,819 * 12/1988 Nelson ..... 323/314
5,349,286 * 9/1994 Marshall et al. ..... 323/315
5,798,637 * 8/1998 Kim et al. ..... 323/313
6,107,868 * 8/2000 Diniz et al. ..... 327/543
6,133,718 * 10/2000 Calafato et al. ..... 323/312

* cited by examiner

*Primary Examiner*—Jeffrey Zweizig
(74) *Attorney, Agent, or Firm*—Myers Bigel Sibley & Sajovec

(57) ABSTRACT

A bias current for an integrated circuit is generated by generating a first bias current that increases with temperature, generating a second bias current that decreases with temperature, and summing the first bias current and the second bias current. Summing may take place by mirroring the first bias current, mirroring the second bias current and summing the mirrored first bias current and the mirrored second bias current. Pull-down circuits also are preferably provided for the circuits that generate the first and second bias currents. The pull-down circuits are responsive to a pulse signal. The pulse signal may be generated from a power-down signal or another signal. Accordingly, bias current generating circuits and methods can have reduced susceptibility to changes in temperature, changes in power supply voltage and/or process variations, and can rapidly produce the bias current.

20 Claims, 2 Drawing Sheets

BIAS CURRENT GENERATING CIRCUITS AND METHODS FOR INTEGRATED CIRCUITS INCLUDING BIAS CURRENT GENERATORS THAT INCREASE AND DECREASE WITH TEMPERATURE

FIELD OF THE INVENTION

This invention relates to integrated circuit devices and operating methods, and more particularly to bias current generating circuits and methods for integrated circuits.

BACKGROUND OF THE INVENTION

Bias current generating circuits and methods are widely used in integrated circuits in order to generate a bias current for the integrated circuit, from an external power supply voltage. For example, field effect transistors such as Metal Oxide Semiconductor (MOS) transistors in an integrated circuit may be controlled by bias currents that are provided by a bias circuit.

In order to provide a controlled amount of bias current, it is desirable for the bias current to remain uniform, notwithstanding changes in the external power supply voltage, changes in temperature and/or integrated circuit fabrication process variations. Moreover, for high-speed integrated circuit devices such as high-speed integrated circuit memory devices, it is desirable for the bias current to rapidly reach a desired level when the integrated circuit transitions from a power-down state to a standby state or an active state. If excessive time is taken to generate the bias current, the operational speed of the integrated circuit may decrease and/or a malfunction may occur.

SUMMARY OF THE INVENTION

The present invention generates a bias current for an integrated circuit by generating a first bias current that increases with temperature of the integrated circuit, generating a second bias current that decreases with temperature, and summing the first bias current and the second bias current. Summing may take place by mirroring the first bias current, mirroring the second bias current and summing the mirrored first bias current and the mirrored second bias current. Pull-down circuits also are preferably provided for the circuits that generate the first and second bias currents. The pull-down circuits are responsive to a pulse signal. The pulse signal may be generated from a power-down signal or another signal. Accordingly, bias current generating circuits and methods can have reduced susceptibility to changes in temperature, changes in power supply voltage and/or process variations, and can rapidly produce the bias current.

More specifically, an embodiment of a bias current generating circuits according to the present invention comprises a first bias current generating circuit that includes a first output terminal and that generates a first bias current that increases with temperature. A second bias current generating circuit includes a second output terminal and generates a second bias current that decreases with temperature. A summing circuit is connected to the first output terminal and to the second output terminal, to sum the first bias current and the second bias current. A first pull-down circuit is connected to the first output terminal, to reduce the voltage of the first output terminal in response to a pulse signal. A second pull down circuit is connected to the second output terminal to reduce the voltage of the second output terminal in response to the pulse signal. A pulse generator is responsive to a transition of a signal, to generate the pulse signal.

The summing circuit preferably comprises a first current mirror that mirrors the first bias current, a second current mirror that mirrors the second bias current and a summing node that sums the mirrored first bias current and the mirrored second bias current.

In a preferred embodiment, the first bias current generating circuit includes a first field effect transistor of a first conductivity type, a first field effect transistor of a second conductivity type, a resistor and a first diode that are serially connected between first and a second reference voltages. A second field effect transistor of the first conductivity type, a second field effect transistor of the second conductivity type and a second diode are serially connected between the first and the second reference voltages. The gates of the first and second field effect transistors of the first conductivity type are connected together to define the first output terminal. The gates of the first and second field effect transistors of the second conductivity type are connected together. The gate of the first field effect transistor of the first conductivity type is connected to the source or drain thereof and the gate of the second field effect transistor of the second conductivity type is connected to the source or drain thereof.

The second bias current generating circuit preferably comprises a first field effect transistor of a first conductivity type, a first field effect transistor of a second conductivity type and a resistor that are serially connected between a first and a second reference voltage. The gate of the first field effect transistor of the first conductivity type is connected to a source or drain thereof, to define the second output terminal.

The summing circuit preferably includes first and second field effect transistors that are connected between a reference voltage and a summing node. The first output terminal is connected to the gate of the first field effect transistor and the second output terminal is connected to the gate of the second field effect transistor.

The first pull-down circuit preferably includes a first field effect transistor that is connected between the first output terminal and a reference voltage, the gate of which is connected to the pulse signal. The second pull-down circuit preferably includes a second field effect transistor that is connected between the second output terminal and the reference voltage, the gate of which is connected to the pulse signal.

According to other embodiments of the present invention, a first current mirror is provided that is responsive to the summing circuit, to mirror the sum of the first bias current and the second bias current at an output terminal thereof. A second current mirror is responsive to the first current mirror, to mirror the current at the output terminal of the first current mirror. A third pull-down circuit is connected to the output terminal of the first current mirror, to reduce the voltage of the first output terminal in response to the pulse signal.

The first current mirror preferably includes first and second field effect transistors that are serially connected between the summing circuit and a reference voltage and third and fourth field effect transistors that are serially connected between the output terminal and the reference voltage. The gates of the first through fourth field effect transistors are connected to the summing circuit. The second current mirror preferably includes a fifth field effect transistor that is connected between a second reference voltage and the output terminal of the first current mirror, and a sixth field effect transistor that is connected to the second reference voltage. The gates of the fifth and sixth field effect transistors are connected to the output terminal of the first current mirror.

According to other embodiments of the present invention, the first bias generating circuit, the second bias generating circuit and the summing circuit may be provided, but the first and second pull-down circuits need not be provided. Accordingly, bias current generating circuits and methods according to the invention can have reduced susceptibility to temperature variations, power supply variations and/or microelectronic fabrication process variations and/or can rapidly provide a desired bias current.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. It will be understood that when an element such as a transistor is referred to as being "connected to" another element, it can be directly connected to the other element or intervening elements may also be present. In contrast, when an element is referred to as being "directly connected to" another element, there are no intervening elements present. Moreover, each embodiment described and illustrated herein includes its complementary conductivity type embodiment as well.

Figure 1:
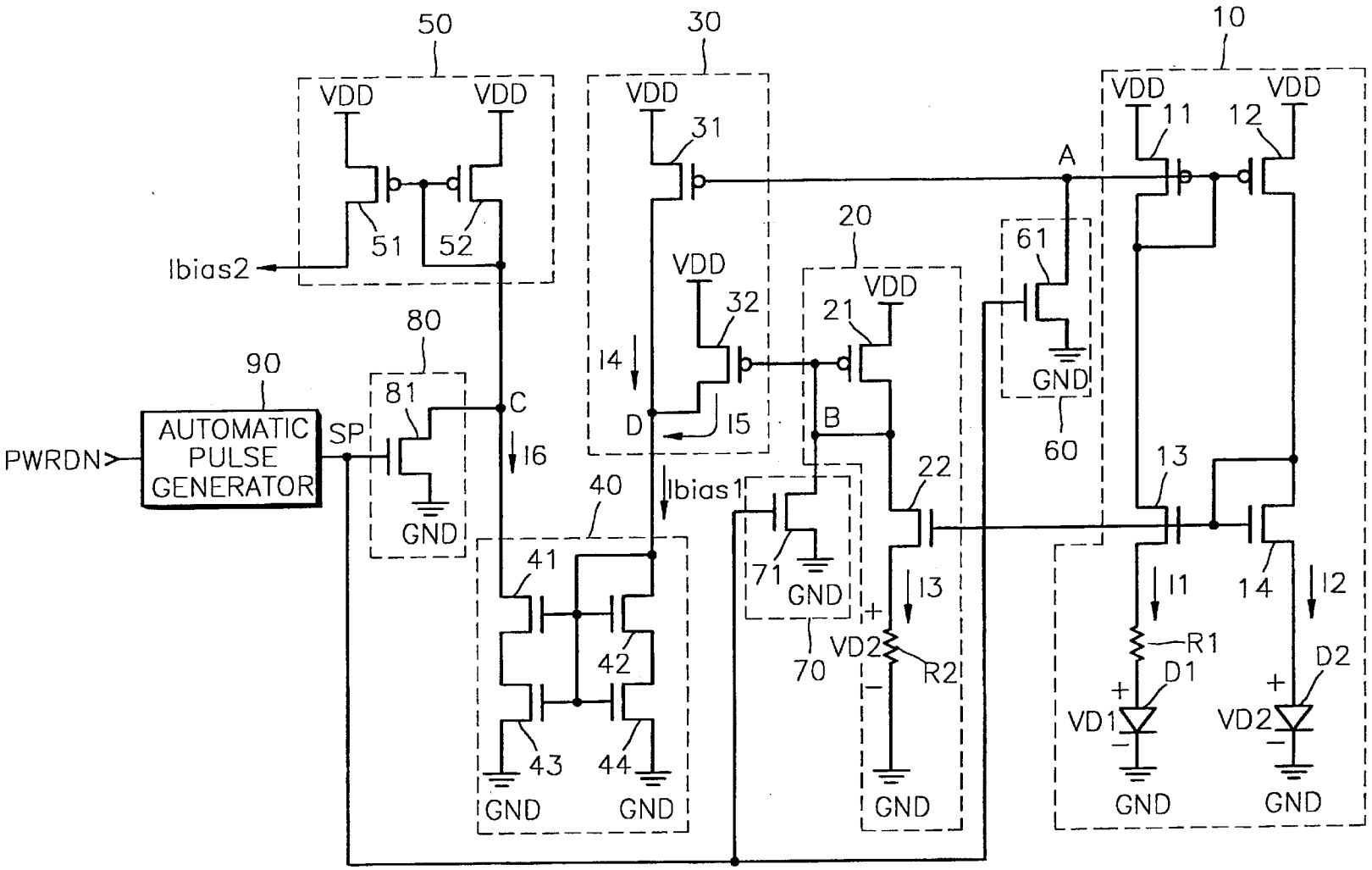
FIG. 1 is a circuit diagram of an embodiment of bias circuits and methods according to the present invention.

Referring now to FIG. 1, bias circuits and methods according to an embodiment of the present invention include a first bias circuit 10, a second bias circuit 20, a current summation (summing) circuit 30, a first pull-down circuit 60, a second pull-down circuit 70, and an automatic pulse generator 90. The bias circuit additionally may include a first current mirror 40, a second current mirror 50, and a third pull-down circuit 80.

The first bias circuit 10 increases the current I1 in accordance with a rise in temperature of the integrated circuit and reduces the current I1 in accordance with a drop in temperature. That is, the current I1 is directly proportional to the temperature. The second bias circuit 20 reduces the current I3 in accordance with a rise in temperature and increases the current I3 in accordance with a drop in temperature. That is, the current I3 is inversely proportional to the temperature. These proportions may be constant, linear or nonlinear. The current summation circuit 30 mirrors the current I1 in response to a signal at an output terminal A of the first bias circuit 10, and mirrors the current I3 in response to a signal at an output terminal B of the second bias circuit 20. The mirrored currents I4 and I5 are summed to output the first bias current Ibias1 at an output terminal D of the current summation circuit 30.

The first pull-down circuit 60 lowers (pulls down) a voltage level of the output terminal A of the first bias circuit 10 in response to a pulse signal such as a startup pulse SP. The second pull-down circuit 70 lowers a voltage level of the output terminal B of the second bias circuit 20 in response to a pulse signal such as the startup pulse SP.

The automatic pulse generator 90 automatically generates the startup pulse (SP) in response to a transition of a signal, such as a transition of a power-down signal PWRDN of an integrated circuit. For example, the automatic pulse generator 90 generates the startup pulse SP when the power-down signal PWRDN of a logic high value transitions to a logic low value. In one embodiment, the power-down signal PWRDN is logic high during the power-down state of the integrated circuit. The signal transitions to a logic low when the power-down state ends, for example when the power-down state transitions to the standby state or to the active state. The automatic pulse generator 90 can be configured so that the automatic pulse generator 90 automatically generates the startup pulse SP in response to a transition of a power-up start detected signal of the integrated circuit. For example, the automatic pulse generator 90 can generate the startup pulse SP when the power-up start detected signal transits from a logic high value to a logic low value. The power-up start detected signal transits from a logic high value to a logic low value after a lapse of a predetermined time from power-up start.

As described above, the bias circuit also may include the first current mirror 40, the second current mirror 50, and the third pull-down circuit 80. The first current mirror 40 mirrors the first bias current Ibias1 from the output terminal D of the current summation circuit 30. The second current mirror 50 mirrors current I6 of an output terminal C of the first current mirror 40, to produce the second bias current Ibias2. The third pull-down circuit 80 lowers the voltage level of the output terminal C of the first current mirror 40 in response to a pulse signal such as the startup pulse SP.

The structure of each of the elements of FIG. 1 now will be described.

The first bias circuit 10 includes PMOS transistors 11 and 12, NMOS transistors 13 and 14, a resistor R1, and diodes D1 and D2. A first reference voltage, such as a power supply voltage VDD is applied to the source of the PMOS transistor 11. The gate of the PMOS transistor 11 and the drain thereof are connected in common to each other and are connected to the output terminal A of the first bias circuit 10. It will be understood that in FIG. 1, the source and drain designations of all the field effect transistors may be reversed. The power supply voltage VDD is applied to the source of the PMOS transistor 12. The gate of the PMOS transistor 12 is connected to the gate of the PMOS transistor 11. The drain of the NMOS transistor 13 is connected to the drain of the PMOS transistor 11 and to the gate thereof. The drain of the NMOS transistor 14 and the gate thereof are connected in common to the drain of the PMOS transistor 12.

A node of the resistor R1 is connected to the source of the NMOS transistor 13, and the other node of the resistor R1 is connected to the positive terminal of the diode D1. A second reference voltage, such as ground voltage GND is applied to the negative terminal of the diode D1. The positive terminal of the diode D2 is connected to the source of the NMOS transistor I4, and ground voltage GND is applied to the negative terminal of the diode D2.

The second bias circuit 20 includes a PMOS transistor 21, an NMOS transistor 22 and a resistor R2. The power supply voltage VDD is applied to the source of the PMOS transistor 21. The gate of the PMOS transistor 21 and the drain thereof are connected to each other and connected to the output terminal B of the second bias circuit 20. The drain of the NMOS transistor 22 is connected to the gate of the PMOS transistor 21 and to the drain thereof. The gate of the NMOS transistor 22 is connected to the gate of the NMOS transistor 13 of the first bias circuit 10. A node of the resistor R2 is connected to the source of the NMOS transistor 22, and a ground voltage GND is applied to the other node of the resistor R2.

The current summation circuit 30 includes PMOS transistors 31 and 32. The power supply voltage VDD is applied to the source of the PMOS transistor 31. The gate of the PMOS transistor 31 is connected to the output terminal A of the first bias circuit 10. The power supply voltage VDD is applied to the source of the PMOS transistor 32. The gate of the PMOS transistor 32 is connected to the output terminal B of the second bias circuit 20. Also, the drain of the PMOS transistor 31 and the drain of the PMOS transistor 32 are connected to each other and connected to an output terminal D of the current summation circuit 30.

The first pull-down circuit 60 includes an NMOS transistor 61. The drain of the NMOS transistor 61 is connected to the output terminal A of the first bias circuit 10. The startup pulse SP is applied to the gate of the NMOS transistor 61, and ground voltage GND is applied to the source of the NMOS transistor 61.

The second pull-down circuit 70 includes an NMOS transistor 71. The drain of the NMOS transistor 71 is connected to the output terminal B of the second bias circuit 20. The startup pulse SP is applied to the gate of the NMOS transistor 71, and ground voltage GND is applied to the source of the NMOS transistor 71.

The first current mirror 40 includes NMOS transistors 41, 42, 43 and 44. The drain of the NMOS transistor 42 and the gate thereof are connected in common to the output terminal D of the current summation circuit 30. The drain of the NMOS transistor 44 is connected to the source of the NMOS transistor 42, the gate of the NMOS transistor 44 is connected to the gate of the NMOS transistor 42, and ground voltage GND is applied to the source of the NMOS transistor 44. The drain of the NMOS transistor 41 is connected to the output terminal C of the first current mirror 40, and the gate of the NMOS transistor 41 is connected to the gate of the NMOS transistor 42 and to the drain thereof. The drain of the NMOS transistor 43 is connected to the source of the NMOS transistor 41. The gate of the NMOS transistor 43 is connected to the gate of the NMOS transistor 41, and ground voltage GND is applied to the source of the NMOS transistor 43.

The second current mirror 50 includes PMOS transistors 51 and 52. The power supply voltage VDD is applied to the source of the PMOS transistor 51. The gate of the PMOS transistor 51 is connected to the output terminal C of the first current mirror 40, and the drain of the PMOS transistor 51 provides the second bias current Ibias2. The power supply voltage VDD is applied to the source of the PMOS transistor 52, and the gate and the drain of the PMOS transistor 52 are connected in common to the output terminal C of the first current mirror 40.

The third pull-down circuit 80 includes an NMOS transistor 81. The drain of the NMOS transistor 81 is connected to the output terminal C of the first current mirror 40. The startup pulse SP is applied to the gate of the NMOS transistor 81, and ground voltage GND is applied to the source of the NMOS transistor 81. Other embodiments of the first bias circuit 10, the second bias circuit 20, the current summing circuit 30, the first current mirror 40, the second current mirror 50 and the first, second and third pull-down circuits 60, 70 and 80 respectively, may be provided.

Figure 2:
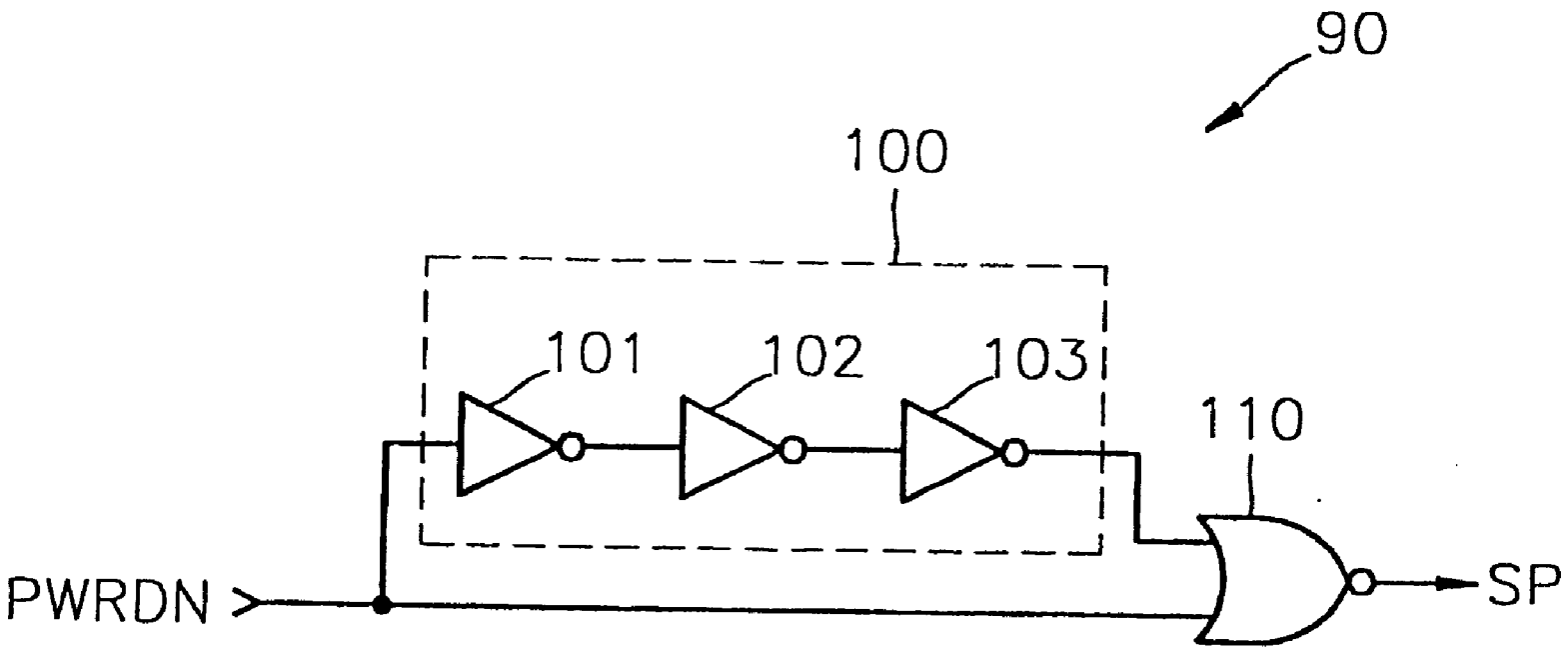
FIG. 2 is a circuit diagram of an embodiment of automatic pulse generating systems and methods of FIG. 1.

Referring now to FIG. 2, an embodiment of an automatic pulse generator includes an inversion delay 100 for inverting and delaying the power-down signal PWRDN by a predetermined time, and a NOR gate 110 for NORing the power-down signal and an output signal of the inversion delay 100, to generate the startup pulse SP. The inversion delay 100 includes a serially connected odd number of inverters, in this case three inverters 101, 102 and 103. Other embodiments of automatic pulse generators may be provided.

The automatic pulse generator generates the startup pulse SP having a pulse width corresponding to the delay time of the inversion delay 100 when the power-down signal PWRDN of a logic high value transitions to a logic low value. The power-down signal PWRDN is high during the power-down state of the integrated circuit. The signal transitions to a logic low value when the power-down state ends, for example when the power-down state transitions to the standby state or to the active state.

Operation of bias circuits and methods according to the present invention now will be described with reference to FIGS. 1 and 2.

The gates of NMOS transistors 13 and 14 of the first bias circuit 10 and the gate of the NMOS transistor 22 of the second bias circuit 20 are connected to each other, so that voltage levels of the gates of the NMOS transistors 13, 14 and 22 are equal. When the resistors R1 and R2 are appropriately controlled, such that the voltage levels of the sources of the NMOS transistors 13, 14 and 22 are equal, Equation 1 is as follows:

$$VD1+I1R1=VD2, \tag{1}$$

where VD1 indicates a voltage between the positive terminal of the diode D1 and the negative terminal thereof of the first bias circuit 10, VD2 indicates a voltage between the positive terminal of the diode D2 and the negative terminal of the diode D2 of the first bias circuit 10, and I1 indicates current passing through the diode D1.

The diode current may be expressed by Equation 2:

$$I=Is\mathrm{EXP}(VD/VT), \tag{2}$$

where Is indicates the saturation current of the diode, VD indicates voltage between the positive terminal of the diode and the negative terminal thereof, and VT indicates thermal voltage. The voltage VD between the positive terminal of the diode and the negative terminal thereof in Equation 2 can be expressed as Equation 3:

$$VD=VT\ \ln(I/Is). \tag{3}$$

Equation 4 is obtained from Equations 1 and 3:

$$VT\ \ln(I1/Is)+I1R1=VT\ \ln(I2/Is), \tag{4}$$

where I1 indicates current passing through the diode D1, and I2 indicates current passing through the diode D2. For example, when the length of the NMOS transistor 14 is the same that of the NMOS transistor 13 and the width of the NMOS transistor 14 is eight times that of the NMOS transistor 13, I2 generally becomes eight times I1. Thus, I1 of Equation 5 can be obtained from Equation 4:

$$I1=(VT\ \ln 8)/R1, \tag{5}$$

where ln 8 is a constant and VT is proportional to KT/q, where K indicates Boltzmann's constant, and T indicates absolute temperature.

Thus, the current I1 of the first bias circuit 10 is proportional to temperature T. That is, when the temperature rises, the current I1 is increased, and when the temperature falls, the current I1 is decreased. Also, the current I3 of the second bias circuit 20 can be expressed by Equation 6:

$$I3=VD2/R2, \tag{6}$$

where, VD2 indicates a voltage between the two terminals of the resistor R2 and the voltage of the positive terminal of the diode D2 is the same as that of the negative terminal thereof. Thus, Equation 7 is obtained from Equations 3 and 6:

$$I3=VT\ln(I2/Is)(1/R2), \quad (7)$$

where Is is proportional to temperature T, and VT is proportional to temperature T.

However, Is is more dominant than VT, so that the current I3 of the second bias circuit 20 is inversely proportional to temperature T. That is, when the temperature rises, the current I3 is reduced and when the temperature falls, the current I3 is increased.

The PMOS transistor 31 of the current summation circuit 30 and the PMOS transistor 11 of the first bias circuit 10 form a current mirror. Thus, the PMOS transistor 31 mirrors the current I1 of the first bias circuit 10 in response to a signal of the output terminal A of the first bias circuit 10, to thereby generate mirrored current I4. Since the current I1 of the first bias circuit 10 is proportional to the temperature, the mirrored current I4 also is proportional to the temperature.

Also, the PMOS transistor 32 of the current summation circuit 30 and the PMOS transistor 21 of the second bias circuit 20 form a current mirror. Thus, the PMOS transistor 32 mirrors the current I3 of the second bias circuit 20 in response to signals of the output terminal B of the second bias circuit 20, to thereby generate mirrored current I5. Since the current I3 of the second bias circuit 20 is inversely proportional to the temperature, the mirrored current I5 also is inversely proportional to the temperature.

The mirrored currents I4 and I5 are summed to thereby provide the first bias current Ibias1. Thus, when the temperature rises, the current I4 increases and the current I5 decreases, and when the temperature falls, the current I4 decreases and the current I5 increases, so that the value of the first bias current Ibias1 preferably is maintained constant regardless of changes in temperature. Also, the value of the first bias current Ibias1 preferably is maintained constant regardless of changes in the power supply voltage VDD and variations in the integrated circuit fabrication process.

The first current mirror 40 mirrors the first bias current Ibias1 that is output from the current summation circuit 30, and the second current mirror 50 mirrors the current I6 that is output from the first current mirror 40. Since the value of the first bias current Ibias1 preferably is maintained constant, the value of the second bias current Ibias2 also preferably is maintained constant regardless of changes in temperature. Also, the value of the second bias current Ibias2 preferably is maintained constant regardless of changes in the power supply voltage VDD and process variations.

When the integrated circuit transitions from the power-down state to the standby state or to the active state, the power-down signal PWRDN of a logic high value transitions to a logic low. Thus, the automatic pulse generator 90 generates the startup pulse SP. The NMOS transistor 61 of the first pull-down circuit 60, the NMOS transistor 71 of the second pull-down circuit 70, and the NMOS transistor 81 of the third pull-down circuit 80 are turned on during the interval of the startup pulse SP. Thus, the voltage level of the output terminal A of the first bias circuit 10, the voltage level of the output terminal B of the second bias circuit 20, and the voltage level of the output terminal C of the first current mirror 40 are pulled down.

As a result, the voltage between the gate of the PMOS transistor 11 of the first bias circuit 10 and the source thereof increases, so that the current passing through the PMOS transistor 11 further increases. Also, the voltage between the gate of the PMOS transistor 21 of the second bias circuit 20 and the source thereof increases, so that the current passing through the PMOS transistor 21 further increases. Thus, the currents I4 and I5 that are mirrored by the PMOS transistors 31 and 32 of the current summation circuit 30 further increase, and the first bias current Ibias1 can rapidly reach a predetermined level.

Finally, the voltage between the gate of the PMOS transistor 52 of the second current mirror 50 and the source thereof increases, to thereby further increase the current passing through the PMOS transistor 52. Thus, the second bias current Ibias2 mirrored by the PMOS transistor 51 of the second current mirror 50 can rapidly reach a predetermined level.

As described above, according to the present invention, a predetermined bias current can be stably supplied regardless of changes in the power supply voltage, temperature and/or the fabrication process, and the bias current can rapidly reach a predetermined level when an integrated circuit in the power-down state transitions to the standby state or to the active state. Improved bias circuits and methods thereby may be provided.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A bias current generating circuit for an integrated circuit comprising:

a first bias current generating circuit that includes a first output terminal and that generates a first bias current that increases with temperature of the integrated circuit;

a second bias current generating circuit that includes a second output terminal and that generates a second bias current that decreases with temperature;

a summing circuit that is connected to the first output terminal and to the second output terminal to sum the first bias current and the second bias current;

a first pull-down circuit that is connected to the first output terminal to reduce a voltage of the first output terminal in response to a pulse signal; and a second pull-down circuit that is connected to the second output terminal to reduce a voltage of the second output terminal in response to the pulse signal.

2. A bias current generating circuit according to claim 1 further comprising a pulse generator that is responsive to a transition of a signal, to generate the pulse signal.

3. A bias current generating circuit according to claim 1 wherein the summing circuit comprises:

a first current mirror that mirrors the first bias current;

a second current mirror that mirrors the second bias current; and a summing node that sums the mirrored first bias current and the mirrored second bias current.

4. A bias current generating circuit according to claim 1 wherein the first bias current generating circuit comprises:

a first field effect transistor of a first conductivity type, a first field effect transistor of a second conductivity type, a resistor and a first diode that are serially connected between first and second reference voltages;

a second field effect transistor of the first conductivity type, a second field effect transistor of the second conductivity type and a second diode that are serially connected between the first and the second reference voltages;

the gates of the first and second field effect transistors of the first conductivity type being connected together to define the first output terminal;

the gates of the first and second field effect transistors of the second conductivity type being connected together;

the gate of the first field effect transistor of the first conductivity type being connected to a source or drain thereof; and the gate of the second field effect transistor of the second conductivity type being connected to a source or drain thereof.

5. A bias current generating circuit according to claim 1 wherein the second bias current generating circuit comprises:

a first field effect transistor of a first conductivity type, a first field effect transistor of a second conductivity type and a resistor that are serially connected between first and second reference voltages;

the gate of the first field effect transistor of the first conductivity type being connected to a source or drain thereof to define the second output terminal.

6. A bias current generating circuit according to claim 1 wherein the summing circuit comprises:

first and second field effect transistors that are connected between a reference voltage and a summing node;

the first output terminal being connected to the gate of the first field effect transistor; and the second output terminal being connected to the gate of the second field effect transistor.

7. A bias current generating circuit according to claim 1:

wherein the first pull-down circuit comprises a first field effect transistor that is connected between the first output terminal and a reference voltage, the gate of which is connected to the pulse signal; and wherein second pull-down circuit comprises a second field effect transistor that is connected between the second output terminal and the reference voltage, the gate of which is connected to the pulse signal.

8. A bias current generating circuit according to claim 1 further comprising:

a first current mirror that is responsive to the summing circuit to mirror the sum of the first bias current and the second bias current at an output terminal thereof;

a second current mirror that is responsive to the first current mirror to mirror the current at the output terminal of the first current mirror; and a third pull-down circuit that is connected to the output terminal of the first current mirror to reduce a voltage of the first output terminal in response to the pulse signal.

9. A bias current generating circuit according to claim 8 wherein the first current mirror comprises:

first and second field effect transistors that are serially connected between the summing circuit and a reference voltage; and third and fourth field effect transistors that are serially connected between the output terminal of the first current mirror and the reference voltage;

the gates of the first through fourth field effect transistors being connected to the summing circuit.

10. A bias current generating circuit according to claim 9 wherein the second current mirror comprises:

a fifth field effect transistor that is connected between a second reference voltage and the output terminal of the first current mirror; and a sixth field effect transistor that is connected to the second reference voltage;

the gates of the fifth and sixth field effect transistors being connected to the output terminal of the first current mirror.

11. A bias current generating circuit according to claim 2, wherein the signal is a power-down signal of the integrated circuit.

12. A bias current generating circuit according to claim 2, wherein the signal is a power-up start detected signal of the integrated circuit.

13. A bias current generating circuit for an integrated circuit comprising:

first means for generating a first bias current that increases with temperature of the integrated circuit;

second means for generating a second bias current that decreases with temperature;

means for summing the first bias current and the second bias current;

first means for pulling-down the first means for generating in response to a pulse signal; and second means for pulling-down the second means for generating in response to the pulse signal.

14. A bias current generating circuit according to claim 13 further comprising means for generating the pulse signal in response to a transition of a signal.

15. A bias current generating circuit according to claim 13 wherein the means for summing comprises:

first means for mirroring the first bias current;

second means for mirroring the second bias current; and means for summing the mirrored first bias current and the mirrored second bias current.

16. A bias current generating circuit according to claim 13 further comprising:

first means for mirroring the sum of the first bias current and the second bias current;

second means for mirroring the first means for mirroring; and third means for pulling-down the first means for mirroring in response to the pulse signal.

17. A bias current generating circuit according to claim 14, wherein the signal is a power-down signal of the integrated circuit.

18. A bias current generating circuit according to claim 14, wherein the signal is a power-up start detected signal of the integrated circuit.

19. A bias current generating method for an integrated circuit comprising the steps of:

generating a first bias current that increases with temperature of the integrated circuit;

generating a second bias current that decreases with temperature;

summing the first bias current and the second bias current;

pulling-down a voltage that controls generating the first bias current, in response to a pulse signal; and pulling-down a voltage that controls generating the second bias current, in response to the pulse signal.

20. A bias current generating method according to claim 19 wherein the summing step comprises the steps of:

mirroring the first bias current;

mirroring the second bias current; and summing the mirrored first bias current and the mirrored second bias current.

* * * * *